US008117801B2

(12) United States Patent
Jambois et al.

(10) Patent No.: US 8,117,801 B2
(45) **Date of Patent: *Feb. 21, 2012**

(54) PULTRUDED BUILDING PRODUCT

(75) Inventors: John Jambois, Fargo, ND (US); Robb Willgohs, West Fargo, ND (US); Shane Allmendinger, Moorhead, MN (US)

(73) Assignee: Tecton Products, LLC, Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/951,362

(22) Filed: Nov. 22, 2010

(65) Prior Publication Data

US 2011/0061327 A1 Mar. 17, 2011

Related U.S. Application Data

(63) Continuation of application No. 11/870,271, filed on Oct. 10, 2007, now Pat. No. 7,856,790.

(51) Int. Cl.
*E04B 1/00* (2006.01)
*E04G 21/00* (2006.01)
*E04G 23/00* (2006.01)

(52) U.S. Cl. ..... 52/748.1; 52/546; 52/522; 52/519

(58) Field of Classification Search ..... 52/748.1, 52/546, 522, 519, 520, 521, 523–528
See application file for complete search history.

(56) References Cited

U.S. PATENT DOCUMENTS 2,988,980 A 6/1961 Tschudin
3,318,056 A 5/1967 Thompson
3,552,078 A 1/1971 Lee
3,828,510 A 8/1974 Bettoli
4,100,710 A 7/1978 Kowallik
4,104,841 A 8/1978 Naz
4,122,643 A 10/1978 Hafner
4,140,841 A * 2/1979 Breiter et al. ..... 429/231.8
4,184,301 A 1/1980 Anderson et al.
4,258,520 A 3/1981 Rehbein
4,272,576 A 6/1981 Britson
4,391,068 A 7/1983 Kosar
4,435,933 A * 3/1984 Krowl ..... 52/309.1
4,476,661 A 10/1984 Hoofe, III
4,637,191 A 1/1987 Smith (Continued)

OTHER PUBLICATIONS

"U.S. Appl. No. 11/032,315, Advisory Action mailed Sep. 9, 2009", 2 pgs.
"U.S. Appl. No. 11/032,315, Final Office Action mailed Jun. 24, 2009", 14 pgs.
"U.S. Appl. No. 11/032,315, Non-Final Office Action mailed Apr. 8, 2008", 13 pgs.

(Continued)

*Primary Examiner* — Eileen D Lillis
*Assistant Examiner* — Chi Nguyen
(74) *Attorney, Agent, or Firm* — Schwegman, Lundberg & Woessner, P.A.

(57) ABSTRACT

A building product is configured for attachment to a surface of a building. In one example, the building product includes a siding product including a first side and a second side. In one example, the siding product is a pultruded product. A first engagement feature is disposed on or near the first side. A second engagement feature is disposed on or near the second side. The second engagement feature is configured to selectively frictionally engage with the first engagement feature of another similar siding product such that any curvature in the siding product increases frictional engagement between the siding product and the other similar siding product. In one example, the building product includes a spacer clip for attachment of the building product to the surface of the building.

19 Claims, 16 Drawing Sheets

U.S. PATENT DOCUMENTS

| | | | | |
|---|---|---|---|---|
| 4,669,238 | A | 6/1987 | Kellis et al. | |
| 4,788,088 | A | 11/1988 | Kohl | |
| 4,930,287 | A | 6/1990 | Volk et al. | |
| 4,947,609 | A | 8/1990 | Champagne | |
| 5,050,362 | A | 9/1991 | Tal et al. | |
| 5,131,200 | A | 7/1992 | McKinnon | |
| 5,475,963 | A * | 12/1995 | Chelednik | 52/545 |
| 3,230,995 | A | 1/1996 | Shannon | |
| 5,564,245 | A | 10/1996 | Rademacher | |
| 5,617,687 | A | 4/1997 | Bussey et al. | |
| 5,651,227 | A | 7/1997 | Anderson | |
| 5,661,939 | A | 9/1997 | Coulis et al. | |
| 5,694,728 | A | 12/1997 | Heath, Jr. et al. | |
| 5,732,520 | A | 3/1998 | Maietta | |
| 5,800,651 | A | 9/1998 | Williamson | |
| 5,819,486 | A | 10/1998 | Goodings | |
| 5,878,543 | A * | 3/1999 | Mowery | 52/519 |
| 6,044,609 | A | 4/2000 | Kim | |
| 6,122,877 | A | 9/2000 | Hendrickson et al. | |
| 6,128,866 | A | 10/2000 | Wearne | |
| 6,128,879 | A | 10/2000 | Bussey et al. | |
| 6,197,412 | B1 | 3/2001 | Jambois et al. | |
| 6,293,064 | B1 | 9/2001 | Larson | |
| 6,311,456 | B1 | 11/2001 | Rodero Antunez | |
| 6,314,704 | B1 | 11/2001 | Bryant | |
| 6,341,463 | B1 | 1/2002 | Dickey et al. | |
| 6,355,333 | B1 | 3/2002 | Waggoner et al. | |
| 6,365,081 | B1 | 4/2002 | Beck | |
| 6,401,428 | B1 | 6/2002 | Glover et al. | |
| 6,415,574 | B2 | 7/2002 | Beck | |
| 6,470,638 | B1 | 10/2002 | Larson | |
| 6,515,062 | B2 | 2/2003 | Jesionka | |
| 6,516,580 | B1 | 2/2003 | Maietta | |
| 6,526,718 | B2 | 3/2003 | Manning et al. | |
| 6,591,567 | B2 | 7/2003 | Hota et al. | |
| 6,594,965 | B2 | 7/2003 | Coulton | |
| 6,637,163 | B2 | 10/2003 | Thibault et al. | |
| 6,871,600 | B2 | 3/2005 | Norton et al. | |
| 6,926,785 | B2 | 8/2005 | Tanzer et al. | |
| 7,114,304 | B2 | 10/2006 | Aota et al. | |
| 7,127,865 | B2 | 10/2006 | Douglas | |
| 7,520,099 | B2 | 4/2009 | Pringle et al. | |
| 7,698,865 | B2 | 4/2010 | Pringle et al. | |
| 7,856,790 | B2 | 12/2010 | Jambois et al. | |
| 2001/0004816 | A1 | 6/2001 | Boyer | |
| 2002/0123288 | A1 | 9/2002 | Davies et al. | |
| 2002/0148382 | A1 | 10/2002 | Norton et al. | |
| 2003/0019175 | A1 | 1/2003 | Kremers | |
| 2003/0136072 | A1 | 7/2003 | Peng | |
| 2004/0182028 | A1 | 9/2004 | Belleau | |
| 2005/0252139 | A1 | 11/2005 | Pringle et al. | |
| 2005/0262791 | A1 | 12/2005 | Pringle | |
| 2006/0000170 | A1 | 1/2006 | Pringle et al. | |
| 2006/0096217 | A1 | 5/2006 | Lance et al. | |
| 2009/0094914 | A1 | 4/2009 | Jambois et al. | |

OTHER PUBLICATIONS

"U.S. Appl. No. 11/032,315, Non-Final Office Action mailed Dec. 29, 2008", 10 pgs.
"U.S. Appl. No. 11/032,315, Notice of Allowance mailed Dec. 2, 2009", 6 pgs.
"U.S. Appl. No. 11/032,315, Response filed Feb. 11, 2009 to Non Final Office Action mailed Dec. 29, 2008", 10 pgs.
"U.S. Appl. No. 11/032,315, Response filed Aug. 21, 2009 to Final Office Action mailed Jun. 24, 2009", 12 pgs.
"U.S. Appl. No. 11/032,315, Response filed Sep. 12, 2008 to Non Final Office Action mailed Apr. 8, 2008", 10 pgs.
"U.S. Appl. No. 11/130,823, Final Office Action mailed Jul. 11, 2008", 6 pgs.
"U.S. Appl. No. 11/130,823, Non Final Office Action mailed Mar. 28, 2007", 6 pgs.
"U.S. Appl. No. 11/130,823, Non-Final Office Action mailed Dec. 18, 2007", 7 pgs.
"U.S. Appl. No. 11/130,823, Notice of Allowance mailed Dec. 12, 2008", 12 pgs.
"U.S. Appl. No. 11/130,823, Pre-Appeal Brief Request for Review filed Jul. 31, 2008", 5 pgs.
"U.S. Appl. No. 11/130,823, Response filed Mar. 18, 2008 to Non-Final Office Action mailed Dec. 18, 2007", 10 pgs.
"U.S. Appl. No. 11/130,823, Response filed Jun. 28, 2007 to Non Final Office Action mailed Mar. 28, 2007", 8 pgs.
"U.S. Appl. No. 11/130,828, Advisory Action mailed Sep. 12, 2008", 3 pgs.
"U.S. Appl. No. 11/130,828, Final Office Action mailed Jun. 2, 2008", 14 pgs.
"U.S. Appl. No. 11/130,828, Non-Final Office Action mailed Sep. 4, 2007", 9 pgs.
"U.S. Appl. No. 11/130,828, Response filed Mar. 4, 2008 to Non-Final Office Action mailed Sep. 4, 2007", 9 pgs.
"U.S. Appl. No. 11/130,828, Response filed Sep. 2, 2008 to Final Office Action mailed Jun. 2, 2008", 8 pgs.
"U.S. Appl. No. 11/870,271, Non-Final Office Action mailed Apr. 2, 2010", 7 pgs.
"U.S. Appl. No. 11/870,271, Notice of Allowance mailed Aug. 18, 2010", 7 pgs.
"U.S. Appl. No. 11/870,271, Response filed Apr. 30, 2010 to Non-Final Office Action mailed Apr. 2, 2010", 15 pgs.
"U.S. Appl. No. 11/870,271, Response filed Dec. 17, 2009 to Restriction Requirement mailed Dec. 9, 2009", 12 pgs.
"U.S. Appl. No. 11/870,271, Restriction Requirement Received Dec. 9, 2009", 5 pgs.
"Mexican Application Serial No. PA/a/2005/005295, Office Action mailed Jul. 29, 2008", 10 pgs.
"Mexican Application Serial No. PA/a/2005/005295, Office action Mailed Feb. 19, 2009", 4 pgs.

* cited by examiner

PULTRUDED BUILDING PRODUCT

CLAIM OF PRIORITY

This application is a continuation of and claims the benefit of priority under 35 U.S.C. §120 to U.S. patent application Ser. No. 11/870,271, now U.S. Pat. No. 7,856,790, filed on Oct. 10, 2007, which is hereby incorporated by reference herein in its entirety.

FIELD

This application relates generally to pultruded products and more specifically to a pultruded building product.

BACKGROUND

Siding on residential and light-commercial buildings is typically made of wood, vinyl, fiber cement, or metal. Wood is not considered "low maintenance" as it is susceptible to warp, rot, and requires frequent repainting. Both vinyl and metal siding need to be slotted when attached to the sheathing of a home because of their high coefficient of thermal expansion (CTE). They have to be carefully nailed in the slots in a manner that allows horizontal movement of the siding as the temperature changes. Warping due to this large CTE is one of the chief drawbacks to these types of siding. Vinyl siding is also susceptible to additional warping because of vinyl's low heat deflection temperature. Solar heat gain on vinyl siding must be minimized to prevent softening of the vinyl, and subsequent warping. The softening of vinyl also occurs simultaneously with a high rate of thermal expansion as the temperature of the vinyl rises, which can make warp and deflection permanent. To reduce solar gain, vinyl siding is typically only sold in light reflecting colors like white and pastels. Dark colors on vinyl siding experience too much solar gain for the vinyl to retain stiffness. Fiber cement siding is heavy and relatively brittle, making it difficult to handle and install. Fiber cement siding requires painting and touching up. Also, fiber cement siding absorbs water. Additionally, fiber cement siding is free-floating, with no interlocking or self-aligning mechanism included with the siding.

Denting of metal siding results from impacts during installation and regular use. Such denting results from the metal siding being formed from thin-skinned metals that dent easily. Siding products that are more dent resistant result in a better quality siding product. Metal siding, being a good thermal conductor, also reduces the insulating value of the wall and acts as a condensation point for moisture.

Weather barriers are often wrapped around the exterior sheathing of buildings to combat the infiltration of water and air. Installing a weather barrier is a separate step in home construction after the sheathing and before siding installation.

The sheathing on a building, typically oriented strand board (OSB), plywood, polystyrene, or fiberboard, acts as a rigid backing for the internal insulation and the external weather barrier. In the case of OSB or plywood, it also acts as a structural reinforcement to increase the shear strength of a building. Less structural sheathing materials require braces or other additional structural members to give the building the necessary shear strength. Sheathing a building is a separate step from wrapping the weather barrier, and installing the siding.

What is needed is a building product to improve on the disadvantages and weaknesses of traditional siding materials, traditional weather barrier, and traditional sheathing.

SUMMARY

A pultruded product which is adapted to be exterior siding of a building.

The pultruded product includes a profile defining a shape of exterior siding and a joint member configured to mate with a joint member of a second pultruded product mounted adjacent the pultruded product.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
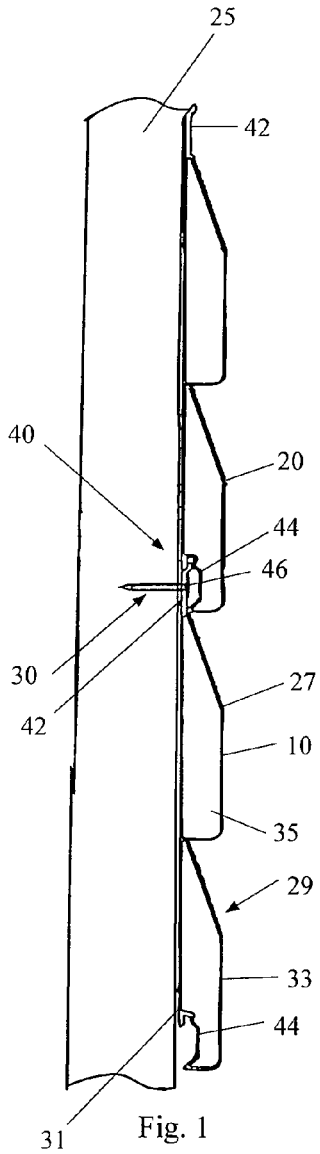
FIG. 1 shows a side view of assembled building products, in accordance with one embodiment.

FIG. 1 shows a side view of assembled building products 10, 20, in accordance with one embodiment. Products 10 and 20 are pultruded products that form the exterior of a building. Products 10, 20 are similar in shape to each other and are described using different numbers for sake of convenience. In one embodiment, products 10 and 20 replace the sheathing, weather barrier, and siding of typical construction. In other words, the pultruded members are configured to be attached directly to a frame 25 of the building and they can have the properties to be exterior siding, a weather-tight barrier, and/or structural sheathing of the building. Accordingly, one or more of these typical building components can be omitted and the time of construction is reduced. Products 10 and 20 are attached to frame 25 of a building with fasteners, such as nails 30 or screws. Thus, for example, a plurality of products 10 and 20 are fastened directly to the 2"×4"s or 2"×6"s used to build the frame of a house. The products 10, 20, are connected at an interlock joint assembly 40, which includes an upper joint member 42 and a lower joint member 44. Each member 10, 20 includes upper and lower joint members 42, 44. A plurality of such members 10, 20 are used to side a building with a series of such members placed adjacent each other. Further details of joint assembly 40 will be discussed below.

The products 10, 20 are formed by pultrusion and can have a wall thickness of about 0.06 inches to about 0.120 inches. Some embodiments have a wall thickness of as small as about 0.03 inches. Some embodiments can have a thickness of about 1 inch or more. The pultrusions can include a coating or a film 27 on at least a portion of the exterior surface of the member for additional protection from elements or ultraviolet protection. For example, the pultrusion and coating can be as described in commonly assigned U.S. Pat. No. 6,197,412, which is incorporated herein by reference in its entirety. Products 10, 20 can be various heights, for example, from three inches or less to 4 feet or more. They can have lengths of up to thirty feet or longer. In this example, the cross-section profile shape of products 10, defines a dutch-lap siding shape. Other continuous cross-section siding shapes are also possible with pultrusion. In some embodiments, these shapes include straight lap, dutch lap, curved lap, beaded, flat, grooved/fluted, and many other profile shapes. Dimension of the lap height are typically three to twelve inches but could be taller or shorter. The number of repeating laps on a given profile are typically one to four but could be many more.

The pultruded products 10, 20 can be formed in virtually any profile shape. Accordingly they can be provided with projecting portions, and other profile shapes, so as to define relief portions 29 on the exterior of the house. For example, each of the pultruded products 10, 20 can include a main body defining a back plane 31 for abutting an outside of the building and one or more sections 33, 35 extending out from the back plane to define relief portions. Accordingly, they can be formed to be aesthetically pleasing such as present siding shapes, as discussed above.

Furthermore, the pultruded products provide protection from wind and rain. Each pultruded member itself is air-tight and weather-tight, and the joint between adjacent members can be sealed to provide an air-tight, rain-tight seal. Moreover, the pultruded products are stiff enough and sturdy enough to provide structural support when attached directly to frame 25. For example, the pultruded products 10, are stiff enough to match or exceed the strength of OSB as sheathing.

Figure 2:
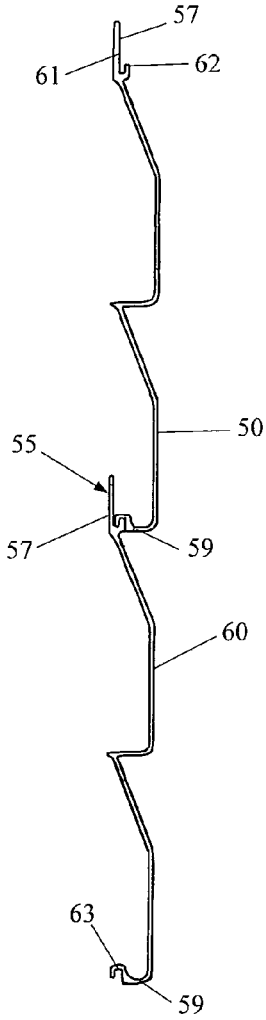
FIG. 2 shows a side view of assembled building products, in accordance with one embodiment.

FIG. 2 shows a side view of assembled building products 50, 60, in accordance with one embodiment. In this embodiment, the assembled members constitute lap siding connected at an interlock joint assembly 55, with each member 50, 60 including an upper joint member 57 and a lower joint member 59. In this example, upper joint member 57 includes a pair of fingers 61, 62 defining a U-shape. Lower joint member 59 includes a curved section 63 defining a U-shape. When assembled, for example, product 60 is fastened to a building through holes in finger 61. U-shaped section 63 is mounted over finger 62 and product 50 is then fastened into place. In some embodiments, a sealing material, such as a gasket, can be placed between joint members 57 and 59.

Figure 3:
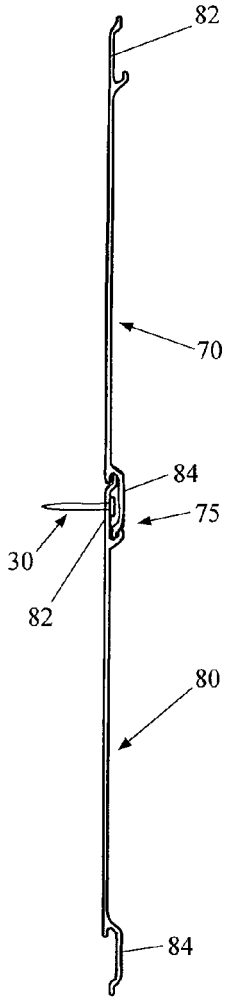
FIG. 3 shows a top view of assembled building products, in accordance with one embodiment.

FIG. 3 shows a side view of assembled building products 70, 80, in accordance with one embodiment. In this embodiment, the assembled members constitute flat siding that could serve as siding only, as sheathing and siding, or as sheathing, siding, and weather-tight barrier. The building products 70, 80, are connected at an interlock joint assembly 75, with each member 70, 80 including an upper joint member 82 and a lower joint member 84.

The present pultruded building products of FIGS. 1-3 are not susceptible to warping due to expansion or softening at elevated temperatures such as vinyl or metal siding. Moreover, they allow for the elimination of installation slots, which makes the present product easier to install, requiring less time and labor. Also, the pultruded members could be installed with any color.

Moreover, since the pultruded members have a relatively high insulative property, they help the insulating value of a structure wall and are less likely to be condensation points for moisture.

In one embodiment, pultruded building products discussed above combine the functionality of sheathing, weather-tight barriers, and/or siding to reduce the labor and time needed to construct a building. In some examples, the building products can offer greater structural support and shear strength to a building versus OSB to allow for a stronger structure, and/or cost savings on other structural members of a building.

As discussed herein, pultrusion is a method of forming composite parts that is automated and continuous. Glass, or other reinforcing fibers, are impregnated with resin and pulled through a forming guide and a heated die. The forming guide orients the fibers to be properly placed in the heated die to insure that the pultruded part has uniform reinforcement across its shape. The heated die cures and/or solidifies the resin around the reinforcing fibers, thus forming the composite part. The composite part, having a profile shape, is continuously pulled out of the heated die by a puller. The puller can be a clamp and stroke action from a reciprocating puller, or a smooth action from a caterpillar puller.

Reinforcing fibers used in the present pultrusion can be glass, carbon fiber, kevlar, and other organic and inorganic filaments and fibers. The most common reinforcement used is glass fibers. Reinforcement fibers can take the form of filament and strand bundles, called rovings. They also take the form of yarns, texturized yarns, chopped strand mats, continuous strand mats, knitted mats, woven mats, surfacing veils, and many hybrid combinations of rovings, yarns, mats, and veils.

Resin used in pultrusion can be thermosetting resins like unsaturated polyesters in a styrene solution, or polyurethanes, phenolics, epoxides, thermosetting blends, and other thermosetting resins. Other resins used in pultrusion can be thermoplastic resins based on polyurethanes, acrylics, polyethylenes, and other thermoplastic resins. Resin used in pultrusion can also be thermoplastic resins that are embedded in rovings that melt and form the part inside the pultrusion die.

Resin mixtures in pultrusion can also contain organic, polymeric, and inorganic additives for such properties as shrink control, mold lubrication, colorants, fillers and other specially additives.

Glass reinforced pultrusions exhibit very low thermal expansion. Thermosetting pultrusions also exhibit dimensional stability and strength even at high temperatures. Pultrusions can be formulated to offer dent resistance.

Figure 4:
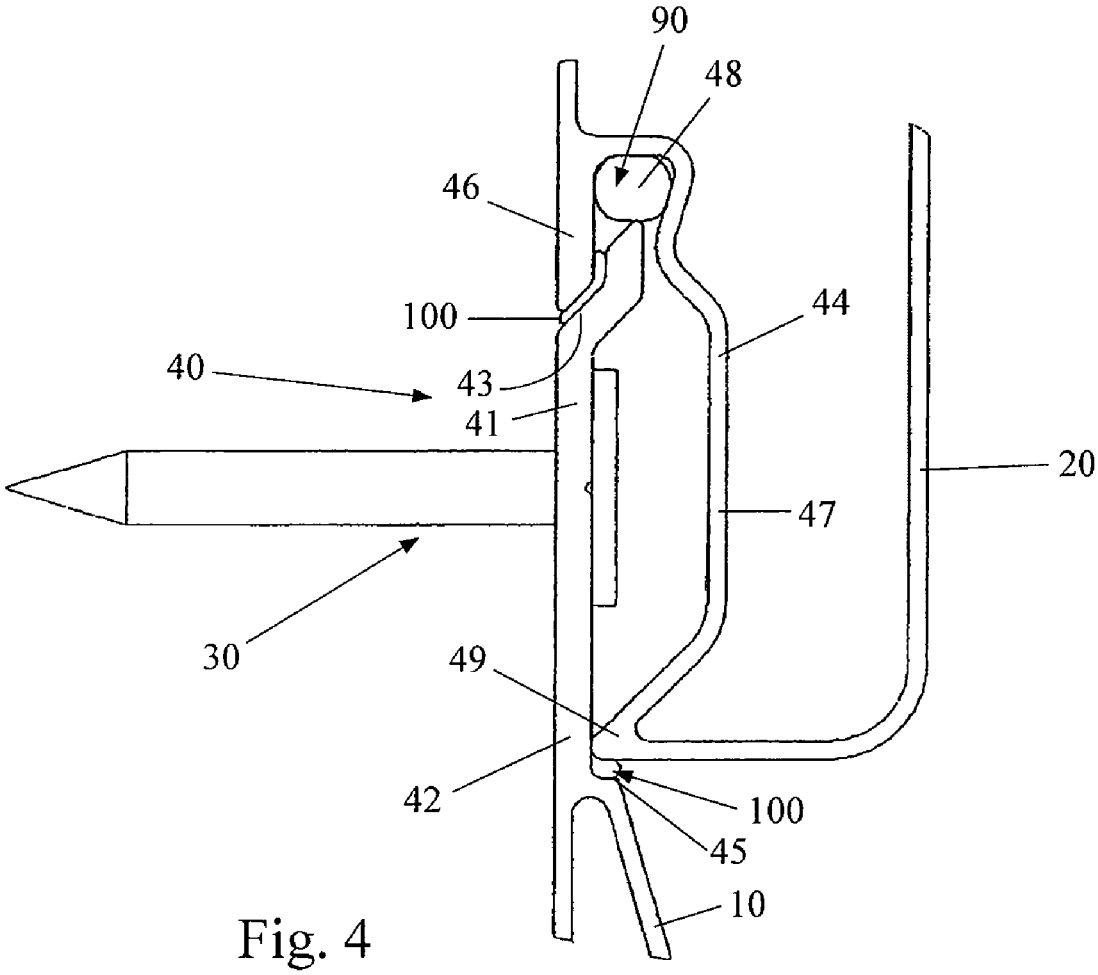
FIG. 4 shows a side view of a joint assembly of the building products of FIG. 1.

FIG. 4 shows a side view of joint assembly 40 of the building products 10, 20. Joint assembly includes upper joint member 42 and lower joint member 44. The terms upper and lower are used herein to describe the relative orientation of the members in view of the Figures. However, in various embodiments, any of the pultruded siding members discussed herein can be mounted horizontally, vertically, or at an angle. Upper joint member includes a finger 41 which extends upwards and outwards to define a shoulder 43. A lower shoulder 45 is formed in a lower portion of joint member 42. Lower joint member 44 includes finger 46 which abuts shoulder 43. An inner wall 47 defines a U-shaped portion 48 and a projection 49. Finger 41 extends into U-shaped portion 48 and projection 49 rests on shoulder 45. Wall 47 is spaced away from finger 41 to provide a space for the head of nail 30. In this example, at least two of the three upper surfaces of finger 41, shoulder 43, and/or shoulder 45 provide support for abutting surfaces of lower joint member 44.

The joint assembly 40 allows for seating of one member to the next. In one embodiment, the interlocking joint assembly 40 also includes sealing members such as foam rope 90 and extruded gaskets 100. The foam and gaskets constitute a multi-point seal to prevent air and rain infiltration providing a weather-tight barrier for the building product system discussed herein.

Figure 5:
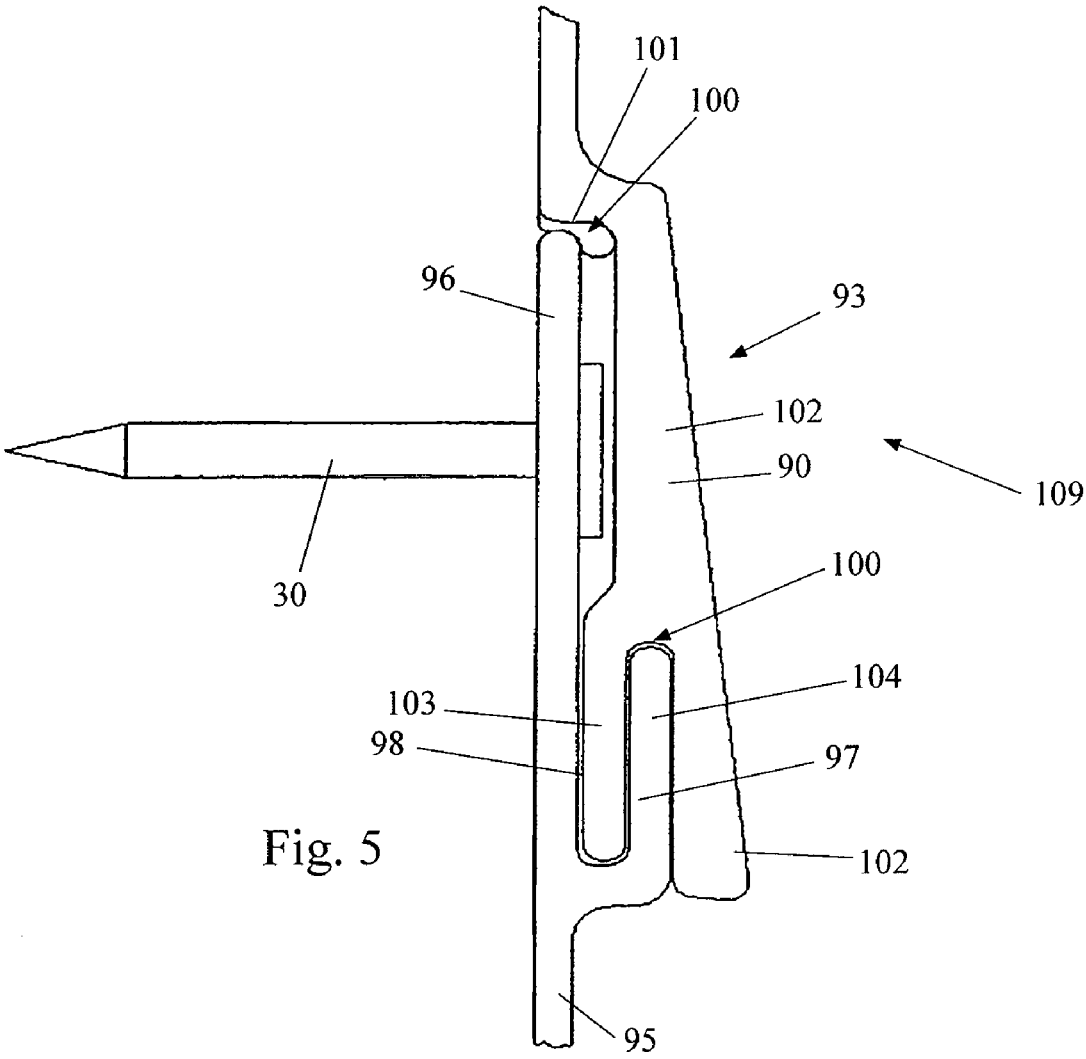
FIG. 5 shows a side view of a joint assembly in accordance with one embodiment.

FIG. 5 shows one embodiment of an interlocking joint assembly 109. In this example, a pair of pultruded members include a lower joint member 90 and an upper joint member 95. Upper joint member 95 includes a first finger 96 and a second finger 97 defining a U-shaped portion 98 therebetween. Fastener 30 can be fastened to a building through a hole in finger 96. Lower joint member 90 includes a curved portion define an upper shoulder 101 and an arm 102 that extends down and divides into a first finger 102 and a second finger 103 that define a U-shaped portion 104. Arm 102 is spaced out from finger 96 to provide a space for the head of fastener 30. When assembled, U-shaped portion 104 envelopes finger 97 while finger 103 extends into U-shaped portion 98. Shoulder 101 abuts the top of finger 96. At least two of the three upper surfaces of finger 96, finger 97 and/or the bottom of U-shaped portion 98 provide support for the downward facing surfaces of shoulder 101, the bottom of U-shaped portion 104, and/or finger 103.

In some embodiments, a sealing member such as gasket material 100 can be provided between the joint members 90 and 95.

Figure 6:
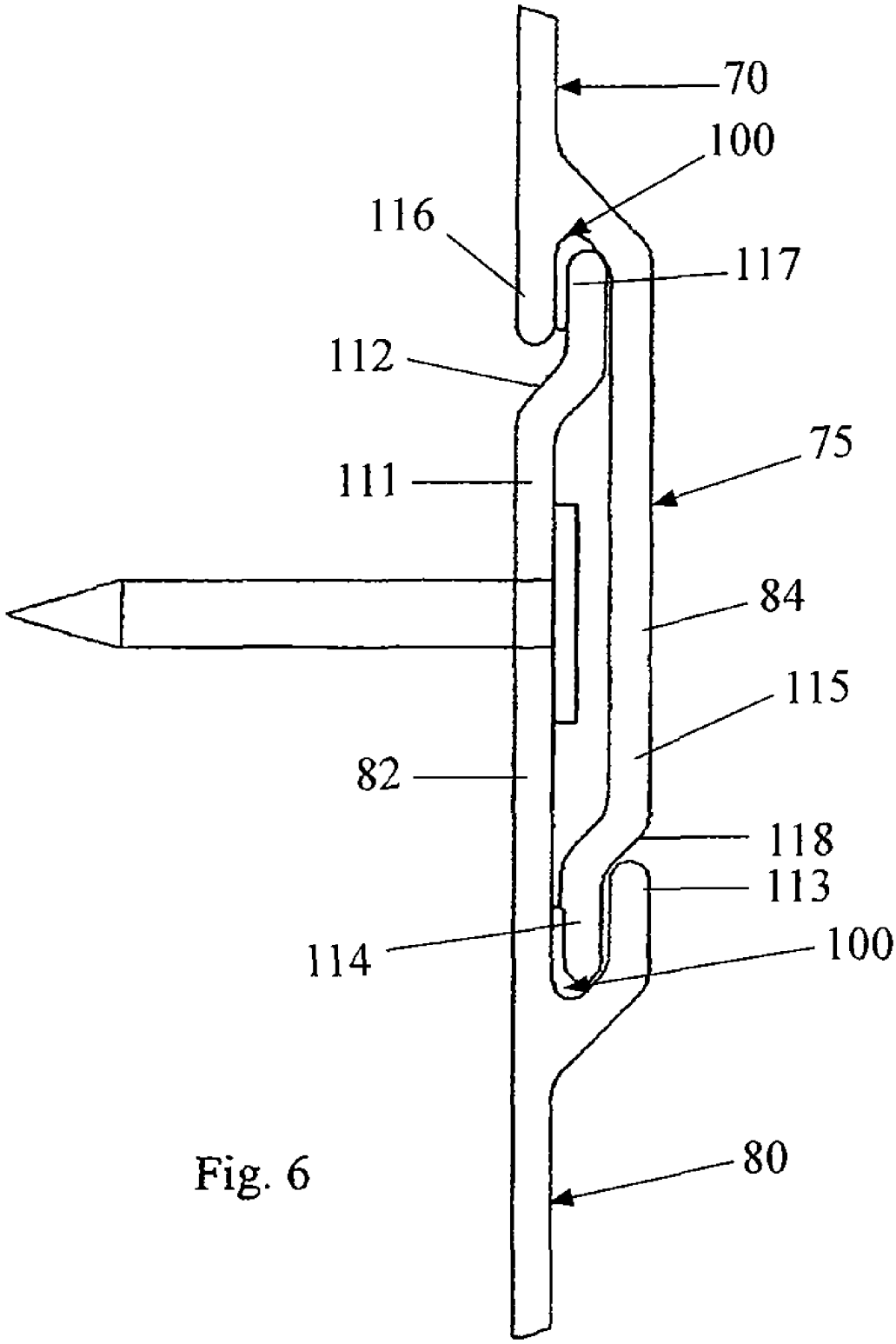
FIG. 6 shows a top view of a joint assembly of the building products of FIG. 3.
Figure 7:
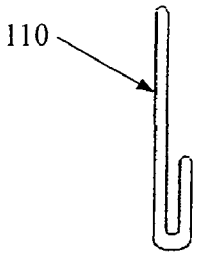
FIG. 7 shows a side view of a trim component for a siding system, in accordance with one embodiment.
Figure 8:
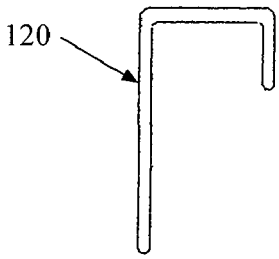
FIG. 8 shows a side view of a trim component for a siding system, in accordance with one embodiment.
Figure 9:
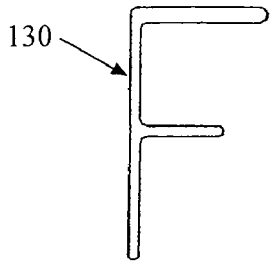
FIG. 9 shows a side view of a trim component for a siding system, in accordance with one embodiment.
Figure 10:
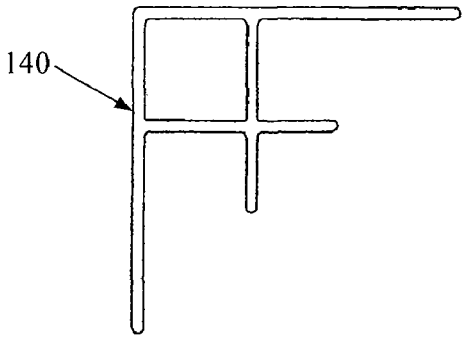
FIG. 10 shows a side view of a trim component for a siding system, in accordance with one embodiment.
Figure 11:
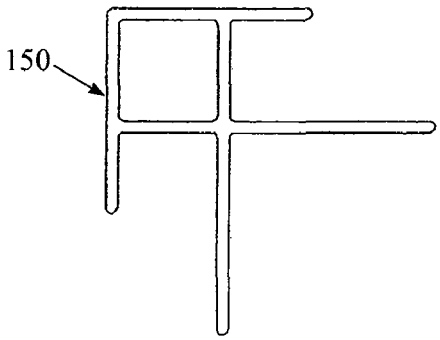
FIG. 11 shows a side view of a trim component for a siding system, in accordance with one embodiment.

FIG. 6 shows a top view of joint assembly 75 of pultruded products 70, 80. In this embodiment, the joint 75 is locking in two places to prevent prying under force. This embodiment is suited for vertically oriented laps, for example. In this embodiment, upper joint member 82 includes a first finger 111 which extends upwards and curves inward defining a shoulder 112. A second finger 113 extends outwards and upwards to define a U-shaped portion or channel 114. Lower joint member 84 includes a first finger 115 which extends into channel 114 and a second finger 116 which defines a U-shaped portion or channel 117. Finger 111 extends into channel 117. Finger 115 includes a shoulder 118. Finger 115 is spaced away from finger 111 to provide space for the head of fastener 30. At least two of the surfaces of joint member 82 contact or abut joint member 84. For example, the surface of shoulder 112, the upper surface of finger 111, the upper surface of finger 113 and/or the bottom of channel 114 can contact the corresponding shoulders and fingers of the corresponding joint member 84. In one example, a sealing member, such as gasket material 100 is provided.

Referring again to FIG. 1, 2, or 3, in use, a plurality of pultruded products 10, 20 (or 50, 60, or 70, 80) are provided. Starting at a bottom of the building a first product 10 is fastened directly to the frame of the building. The fasteners can be nailed all the way into the frame through the pultruded product, for example through finger 41 of joint member 42. In some embodiments, one or more guiding or mounting holes 46 can be provided in the pultruded product. For example, the holes can be located through finger 42. This is in contrast to how vinyl siding is hung. Vinyl siding is loosely hung through elongate slots in the siding. This is because of the high CTE of vinyl. (Typically about $33\times10^{-6}$ in/in/F). In contrast, the pultruded products of the present system have a CTE of about $4\times10^{-6}$ in/in/F or less. In various embodiments, the CTE can be from about 3 to about $5\times10^{-6}$ in/in/F. This allows them to be tightly fastened to the frame because there is no danger of them expanding enough to come loose. Tightly fastening the pultruded members to the building also provides for a sturdy structure, which, in one example, can be used to replace the traditional sheathing of a building.

After product 10 is mounted to the building, the second product 20 is placed adjacent the first product such that joint 42 mates with joint 44. In this example, at least two points of support are provided between the upper and lower joints. One embodiment provides a sealing material on all the abutting surfaces so as to provide a three-point (or more) seal. The joint members are further designed such that the lower joint covers the fastener 30 of the lower product. After the upper product is fastened to the frame, the process is repeated.

In various examples, the pultruded products can be made having profiles defining the following siding styles: straight lap, curved lap, dutch lap, flat, beaded, fluted, reeded, or smooth siding. In one or more examples, a pultruded part can contain one or more repeating siding features per part. In some embodiments, any of the pultruded products discussed can be used as horizontal siding, vertical siding, or angled siding.

FIGS. 7-11 show embodiments of some trim components for assembly of the present system onto a structure. These components include starter strips 110, j-channel 120, f-channel 130, inside corners 140, and outside corners 150. For example, starter strip 110 can include a shape defining an upper joint portion to mate with the lower joint portion 84 (FIG. 5) of one or more of the plurality of pultruded products discussed above. Starter strip 110 can be used as the first element when siding a building, with the pultruded products (such as product 80) then added to it. J-channel 120 is used when a siding member meets a window or door. F-channel 130 is used when a siding member meets a soffit. Inside corner 140 and outside corner 150 are for inside and outside corners where one wall of siding meets another wall of siding. Other details of one or more embodiments of FIGS. 1-11 are described in U.S. patent application Ser. No. 11/032,315, filed on Jan. 10, 2005, entitled "PULTRUDED BUILDING PRODUCT", the disclosure of which is incorporated herein by reference in its entirety.

FIGS. 12-18 show views of a building product 210, in accordance with one embodiment. In one example, the building product 210 is configured to be attached to a surface of a building or other structure to form the exterior of the building. The building products 210, in one example, replace the sheathing, weather barrier, and siding of typical construction. In other words, the building products 210 are configured to be attached directly to a frame 225 of the building. Thus, for example, a plurality of building products 210 are fastened directly to the 2"×4"s or 2"×6"s used to build the frame of a house. In this example, the building products 210 can have the properties to be exterior siding, a weather-tight barrier, and/or structural sheathing of the building. Accordingly, one or more of these typical building components can be omitted and the time of construction is reduced. In one example, the building product 210 attaches to a building having house wrap 232 and sheathing 230 attached to the frame 225 of the building. In one example, several building products 210 of similar configurations are used to cover at least a portion of the surface of the building.

The building product 210 of this example includes a siding product 212. The siding product 212 in one example is a pultruded product 212 generally similar to the pultruded products 10, 20 described above. The pultruded product 212 of this example includes a first side 212A and a second side 212B. The pultruded product 212 includes a first engagement feature 214 disposed on or near the first side 212A. In one example, the first engagement feature 214 generally includes a channel or slot disposed proximate the first side 212A and extending at least partially along the length of the pultruded product 212. In one example, the first engagement feature 214 is a slot that is downwardly-facing or, in other words, open in a direction generally toward the second side 212B of the pultruded product 212. The pultruded product 212 of this example further includes a second engagement feature 216 disposed on or near the second side 212B. In one example, the second engagement feature 216 is a generally upturned lip or tab extending at least partially along the length of the pultruded product 212. In one example, the second engagement feature 216 is a tab that is oriented in a direction generally toward the first side 212A of the pultruded product 212. The second engagement feature 216 is configured to selectively frictionally engage with the first engagement feature 214 of another similar pultruded product 212 such that any curvature in either or both of the pultruded products 212 increases frictional engagement between the pultruded product 212 and the other similar pultruded product 212.

Figure 16:
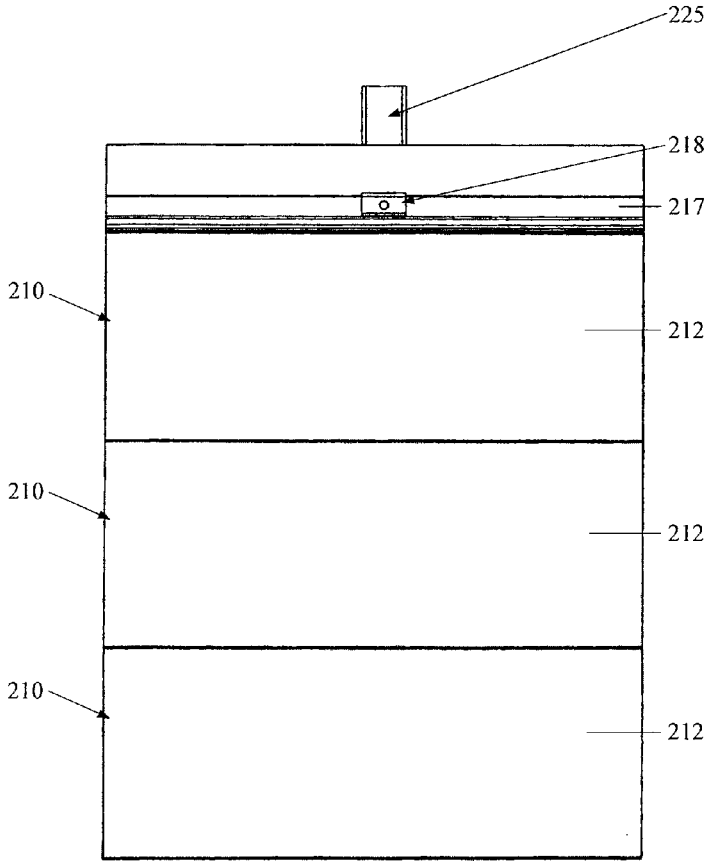
FIG. 16 shows a front view of assembled building products, in accordance with one embodiment.
Figure 17:
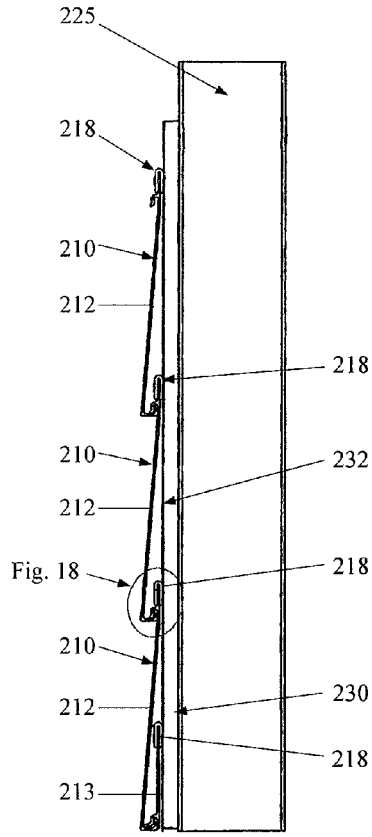
FIG. 17 shows a side view of the assembled building products of FIG. 16.
Figure 18:
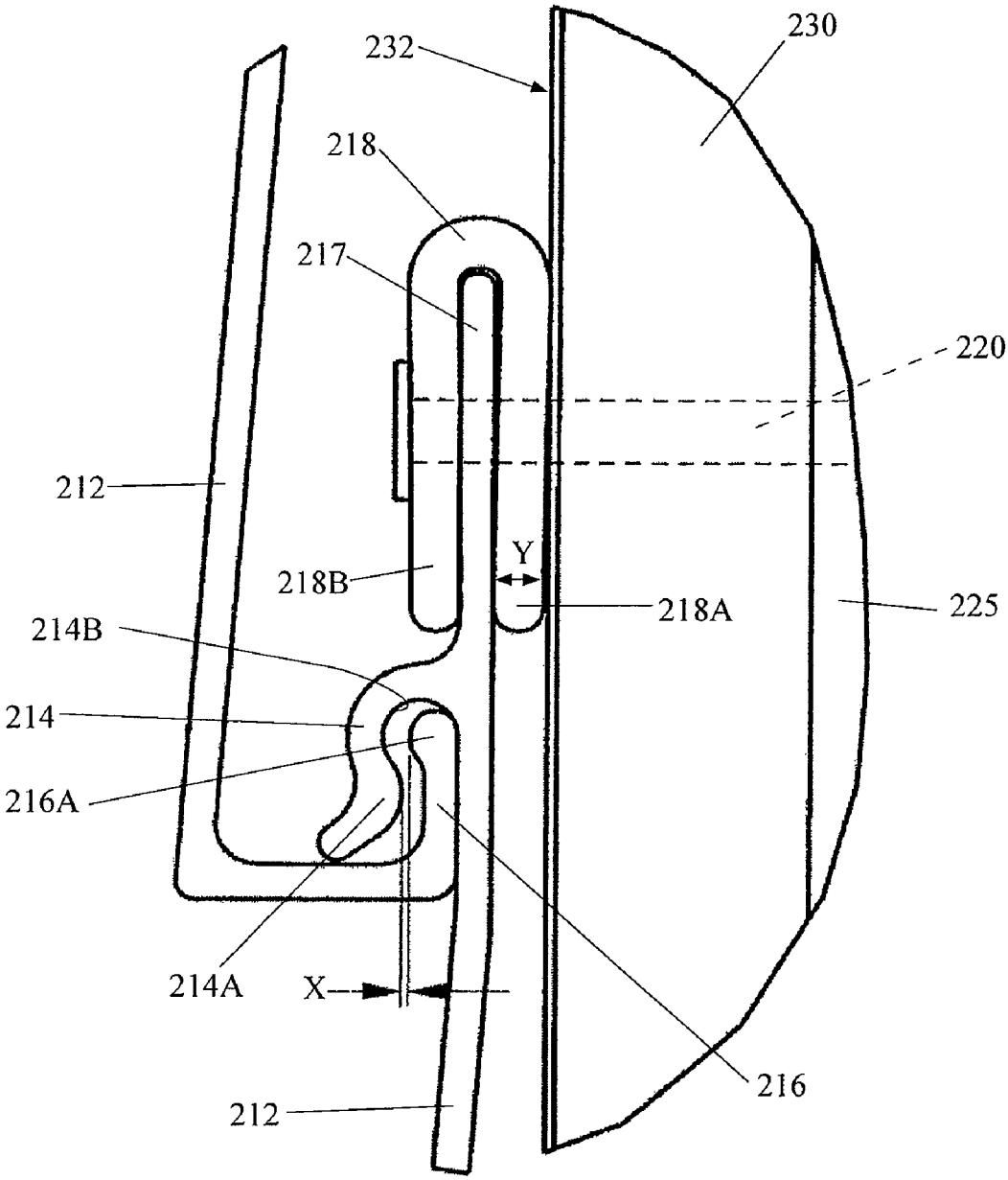
FIG. 18 shows an enlarged fragmentary view of a joint between two assembled building products of FIG. 17.

Referring specifically to FIGS. 16-18, several building products 210 are shown assembled to form a partial exterior structure of a building. As seen in FIG. 18, the second engagement feature 216 of one pultruded product 212 is disposed within the first engagement feature 214 of another pultruded product 212 to form a joint therebetween. In one example, the channel of the first engagement feature 214 includes a bump 214A extending from one wall of the channel toward the other wall of the channel, and the lip of the second engagement feature 216 includes an enlarged end 216A. In one example, the first and second engagement features 214, 216 are configured to engage each other with a clearance distance X between the bump 214A of the first engagement feature 214 and the enlarged end 216A of the second engagement feature 216. The clearance distance X allows for the second engagement feature 216 to be relatively easily placed within the first engagement feature 214 to form the joint. Curvature present in the pultruded products 212 of mating building products 210, however, causes at least a portion of the joint to have no clearance distance X. In other words, curvature causes the enlarged end 216A of the second engagement feature 216 to become disposed within a recess 214B of the first engagement feature 214 along at least a portion of the joint, effectively creating a snap fit between the first and second engagement features 214, 216. Such curvature in the pultruded products 212 can result from a number of causes. For instance, in one example, curvature of the pultruded product 212 results from attachment of the pultruded product 212 with the surface of the building, wherein the surface of the building is not perfectly flat. That is, the building surface includes a curvature, which the pultruded product 212 assumes when attached thereto. In another example, curvature of the pultruded product 212 results from manufacturing of the pultruded product 212. In one such example, the curvature is purposely introduced into the pultruded product 212. In another example, curvature of the pultruded product 212 occurs as a byproduct of the manufacturing process. In other examples, other factors result in curvature of the pultruded product 212, either before or after fastening to a building, to allow for engagement between first and second engagement features 214, 216 of the pultruded products 212 of mating building products 210.

Figure 12:
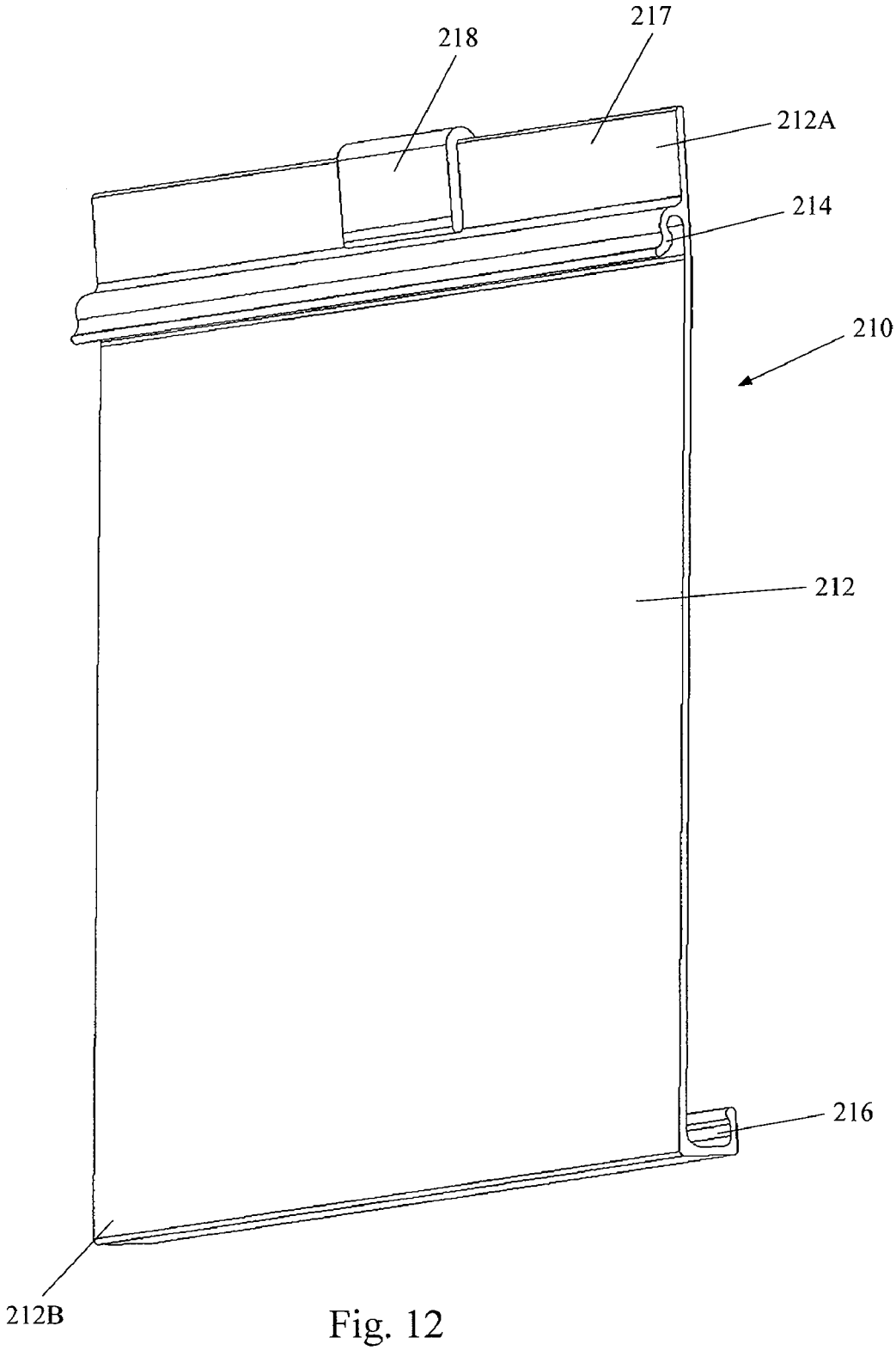
FIG. 12 shows a perspective view of a building product, in accordance with one embodiment.
Figure 13:
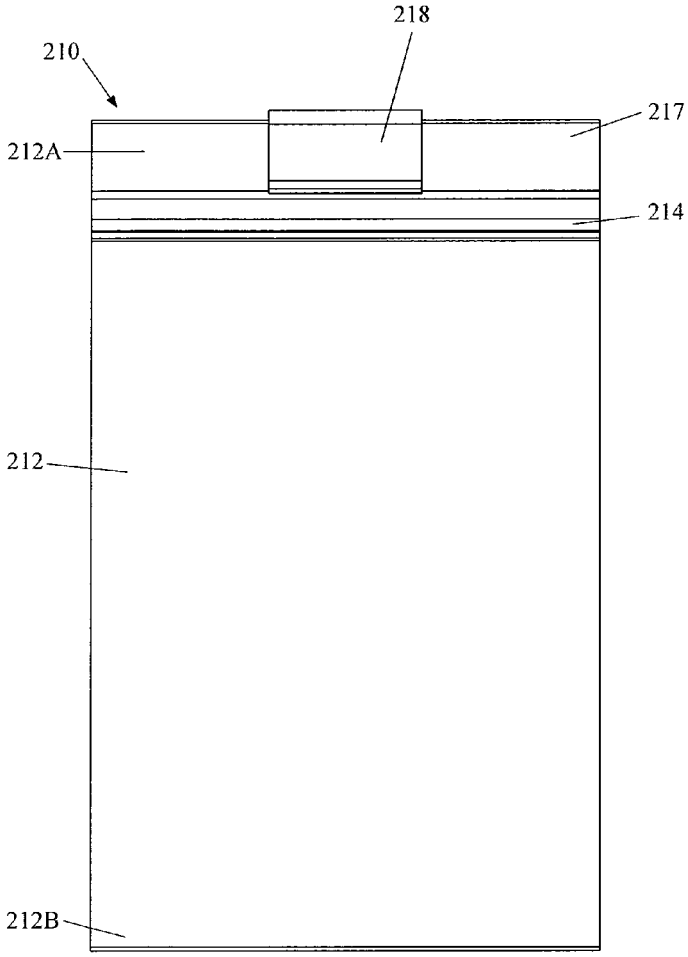
FIG. 13 shows a front view of the building product of FIG. 12.

Referring now to FIGS. 12 and 18, in one example, the pultruded product 212 includes an attachment portion 217 configured to fasten the pultruded product 212 to the building. In one example, the attachment portion 217 is integrally formed in the pultruded product 212. In one example, the attachment portion 217 is disposed on or near the first side 212A of the pultruded product 212. The attachment portion 217, in one example, is a tab extending upwardly at the first side 212A of the pultruded product 212. In another example, the attachment portion 217 extends upwardly from the first engagement feature 214 of the pultruded product 212.

Figure 14:
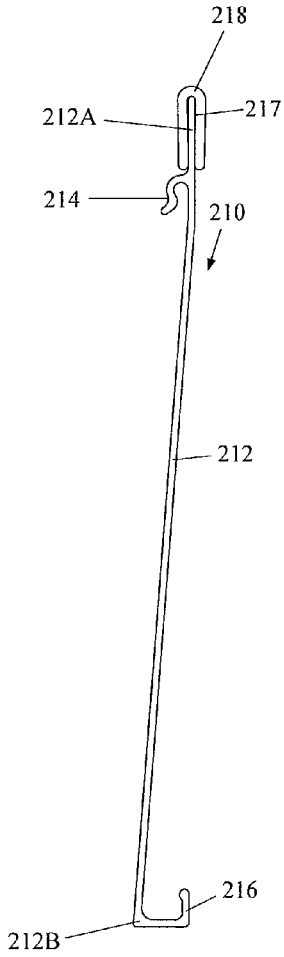
FIG. 14 shows a side view of the building product of FIG. 12.

In one example, the attachment portion 217 is configured to frictionally engage with a clip 218 configured to space the building product 210 a distance from the surface of the building. The clip 218, in one example, is a spacer clip 218 for attachment of a building product 210 to the surface of a building. In one example, the clip 218 includes a first leg 218A. The clip 218, in one example, includes a second leg 218B coupled with the first leg 218A to form a U-shape. The first and second legs 218A, 218B can have various lengths. In one example, as shown in FIGS. 14, 17, and 18, the first and second legs 218A, 218B are generally similar lengths. In other examples, the first and second legs 218A, 218B can have a different lengths. For instance, the first leg 218A can be longer than the second leg 218B, or the first leg 218A can be shorter than the second leg 218B. In one example, the first and second legs 218A, 218B are configured to accommodate a portion, for instance, the attachment portion 217 discussed above, of the building product 210 therebetween for frictional engagement therewith. In one example, the second leg 218B is angled toward the first leg 218A, such that the gap between the first and second legs 218A, 218B narrows. In one example, the gap is narrowest at the point of the gap farthest from the point where the first and second legs 218A, 218B are coupled. In still another example, the building product 210 includes one or more integrally-formed bumps extending rearwardly from the attachment portion 217. The one or more bumps of this example essentially function to space the building product 210 a distance from the surface of the building in a manner similar to that described herein with respect to the spacer clip 218.

Referring to FIGS. 17 and 18, in one example, when the building product 210 is attached to the surface of the building, the first leg 218A is disposed between the building product 210 and the surface of the building. The first leg 218A has a thickness to space the building product 210 a distance Y away from the surface of the building. By spacing the building product 210 away from the surface of the building in this manner, condensation and other moisture, which becomes disposed between the building product 210 and the building, is allowed to drain. Furthermore, the spacing created by the clip 218 allows for ventilation between the building product 210 and the building. In this example, by using the clips 218 when attaching the building products 210 to the building, a water drainage and ventilation plane is created.

In one example, the clip 218 is slidable along the attachment portion 217 of the building product 210. The slidable clips 218 allow for one or more clips 218 to be attached to and packaged with the building product 210 and then repositioned along the building product 210 during installation to align the clips 218 with the studs or other frame members of the frame 225 of the building. Once aligned with the studs or other frame members of the frame 225, in one example, a fastener 220 is used to couple the building product 210 to the frame 225. In one example, as shown in FIG. 18, the fastener 220 is placed through the clip 218 and the attachment portion 217 of the pultruded product 212 and into the frame 225 to attach the building product 210 to the frame 225. In one example, the clip 218 includes a hole therethrough to facilitate placing the fastener 220 through the clip 218. In another example, the clip 218 does not include a hole therethrough, but is configured to allow the fastener 220 to be driven through the clip 218 during attachment of the building product 210 to the building. It is contemplated that various fasteners 220, including screws, nails, and the like, are used to attach the building product 210 to the frame 225 or other portion of the building. In one example, the clip 218 is formed from polyvinyl chloride (PVC). In another example, the clip 218 is formed from acrylonitrile butadiene styrene (ABS) plastic. However, the materials of these examples are not intended to be limiting, as the clip 218 can be formed from other materials in other examples, provided the clip 218 can perform in the manner described herein. By using the clips 218 to attach the building products 210 to the building, as described above, furring strips, as used with other types of siding, can be eliminated. By eliminating the step of attaching furring strips to the building, potentially, time can be saved and material costs can be lessened.

Figure 15:
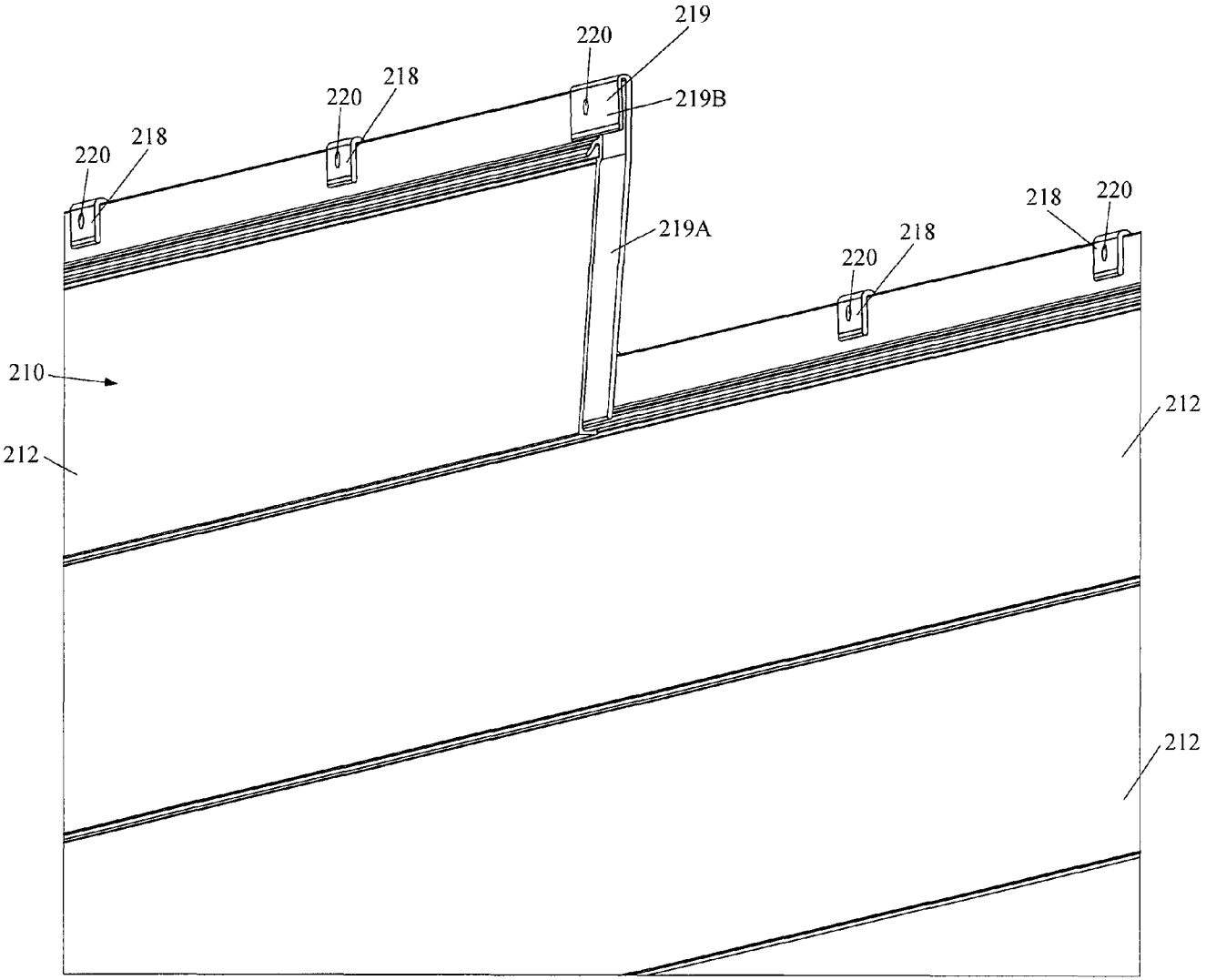
FIG. 15 shows a perspective view of assembled building products, in accordance with one embodiment.

Referring now to FIG. 15, in one example, a flashing clip 219 is used between side-by-side building products 210. In one example, the flashing clip 219 includes a first leg 219A that is longer than a second leg 219B. The flashing clip 219 is similar to the clip 218 discussed above, except that the first leg 219A of the flashing clip 219 is longer than the first leg 218A of the clip 218 described above. In one example, the first leg 219A is sized to extend along a majority of the height of the pultruded product 212. In one example, the flashing clip 219 is placed along the butt joint between two side-by-side building products 210 and is configured to assist in maintaining the joint and to inhibit incursion of water through the joint. In one example, the flashing clip 219 is wide enough to allow a portion of the flashing clip 219 to be positioned in frictional engagement with each of the abutting pultruded products 212, with the portions being sufficiently wide to allow fasteners 220 to be driven through each portion during attachment of the building products 210 with the building. In one example, the flashing clip 219 is attached to at least one of the building products 210 using a fastener 220. In another example, the flashing clip 219 is attached to only one of the building products 210 using a fastener 220.

Figure 19:
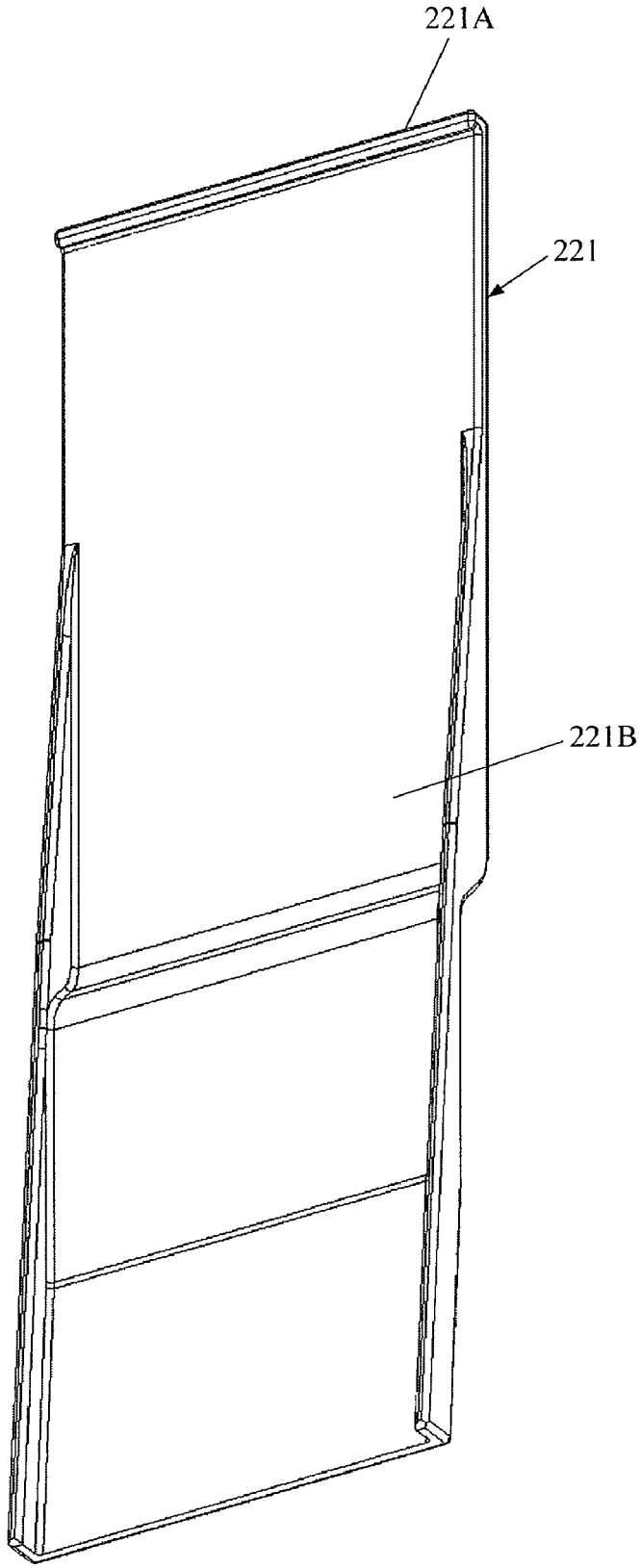
FIG. 19 shows a perspective view of a seam support member, in accordance with one embodiment.
Figure 20:
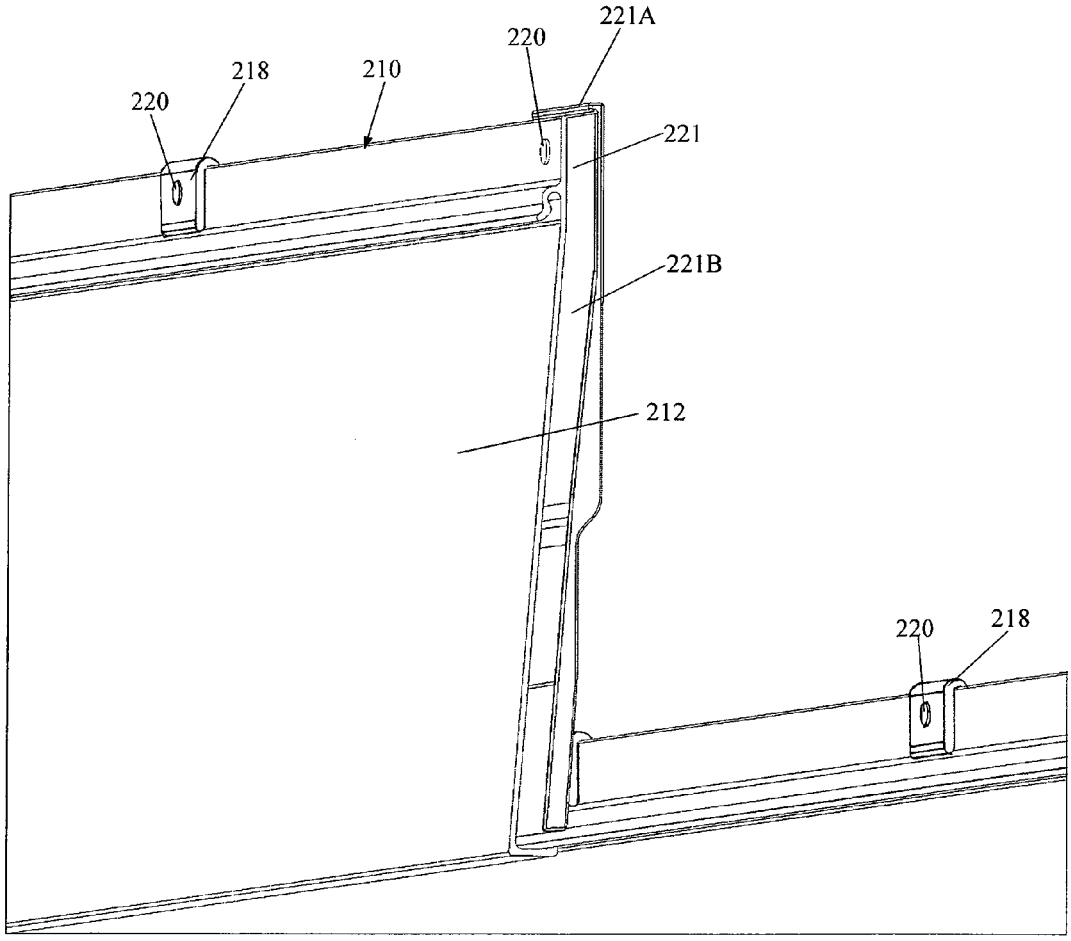
FIG. 20 shows a perspective view of assembled building products, in accordance with one embodiment.
Figure 21:
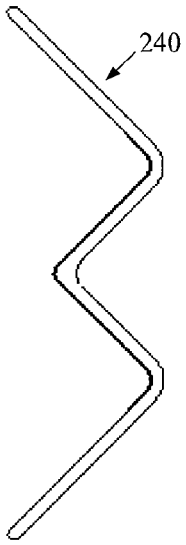
FIG. 21 shows a side view of a trim component for a siding system, in accordance with one embodiment.
Figure 22:
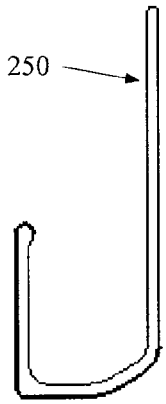
FIG. 22 shows a side view of a trim component for a siding system, in accordance with one embodiment.
Figure 23:
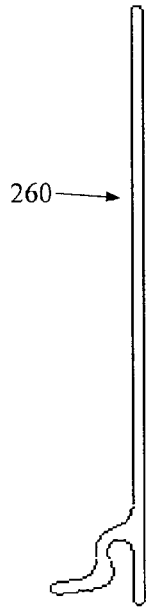
FIG. 23 shows a side view of a trim component for a siding system, in accordance with one embodiment.
Figure 24:
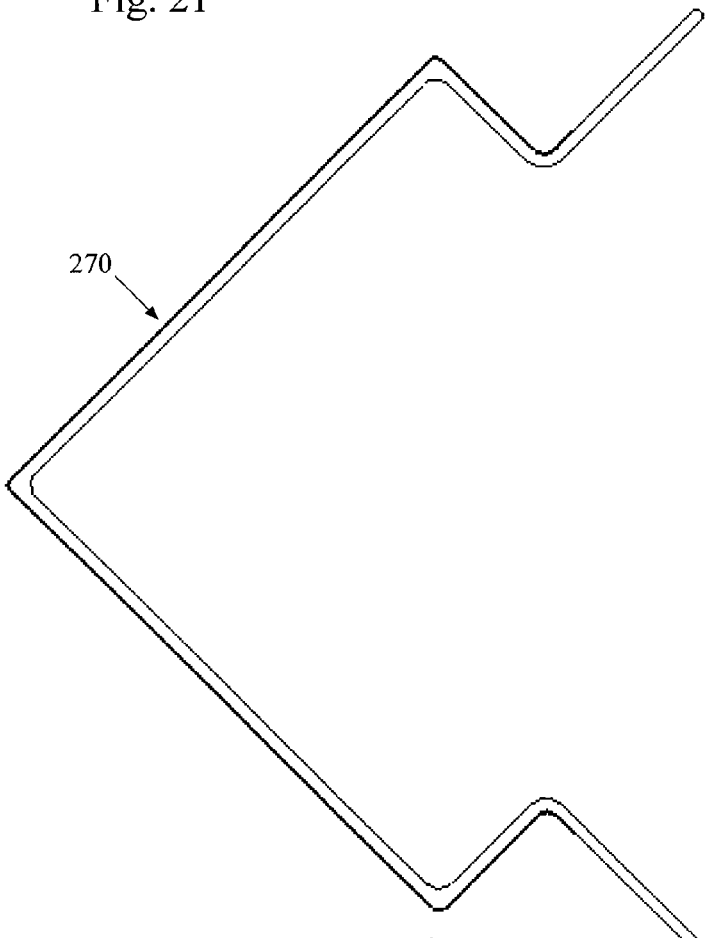
FIG. 24 shows a side view of a trim component for a siding system, in accordance with one embodiment.
Figure 25:
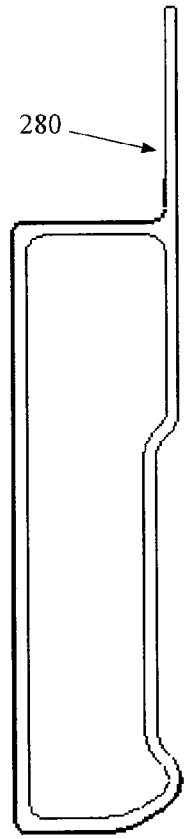
FIG. 25 shows a side view of a trim component for a siding system, in accordance with one embodiment.
Figure 26:
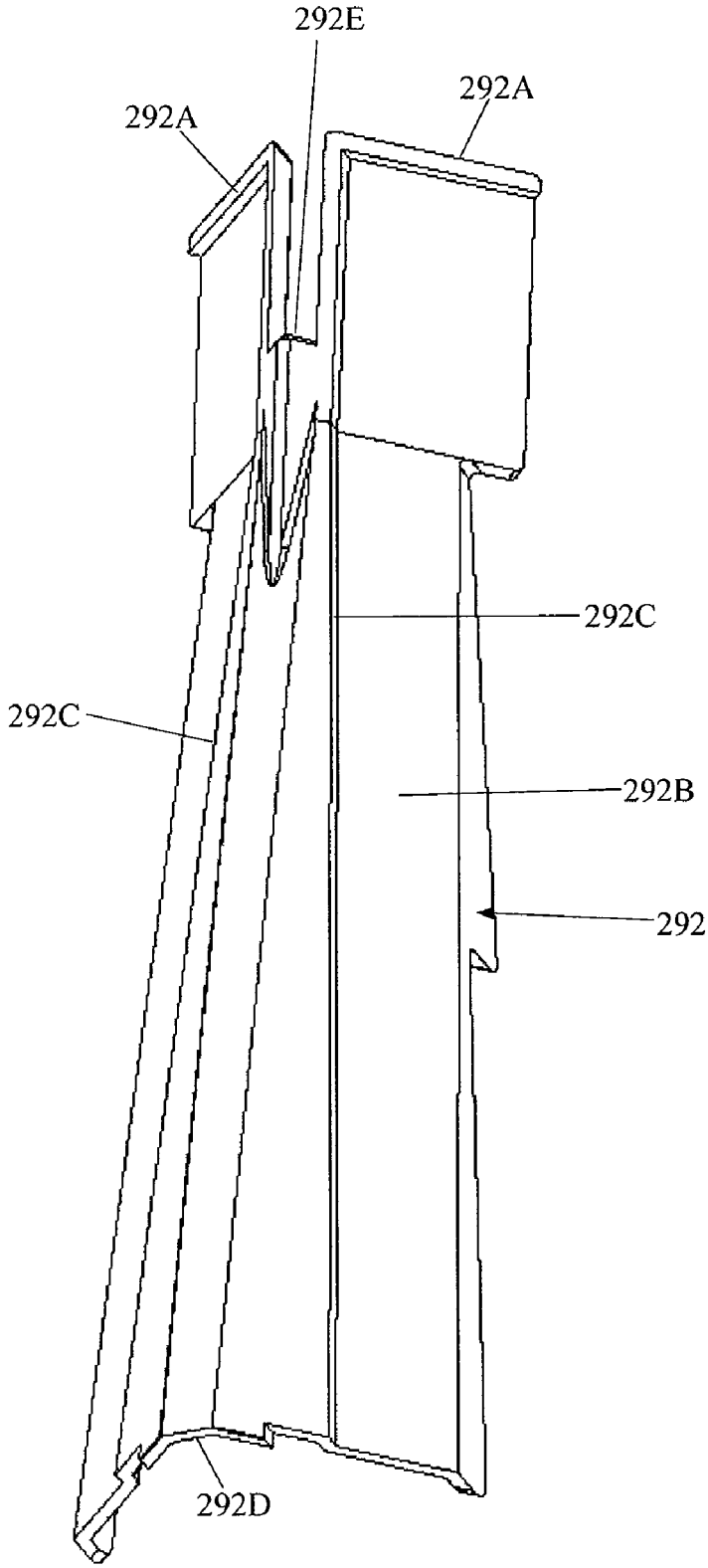
FIG. 26 shows a perspective view of a corner backer component for a siding system, in accordance with one embodiment.
Figure 27:
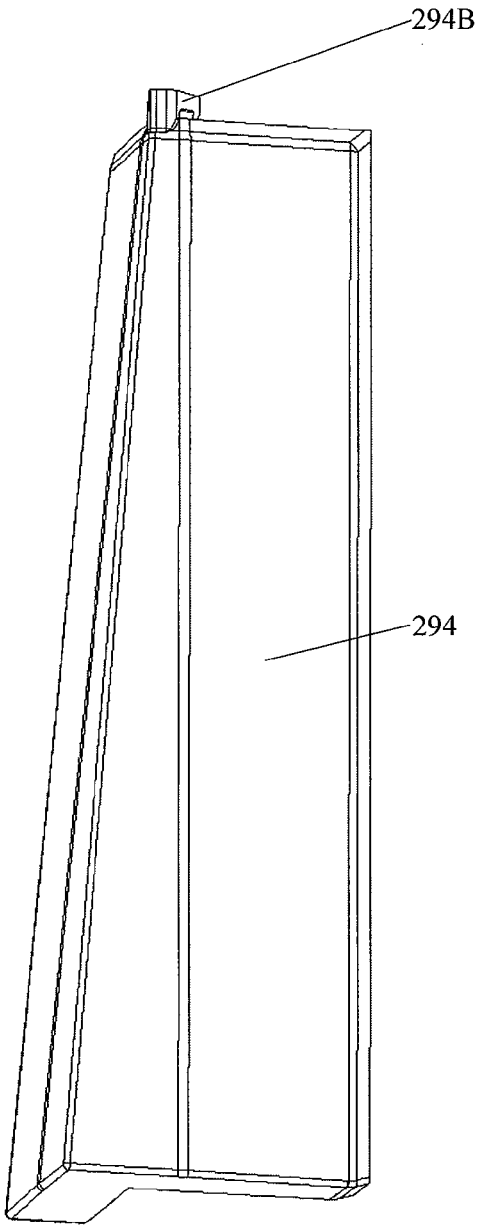
FIG. 27 shows a front perspective view of a corner fascia component for a siding system, in accordance with one embodiment.
Figure 28:
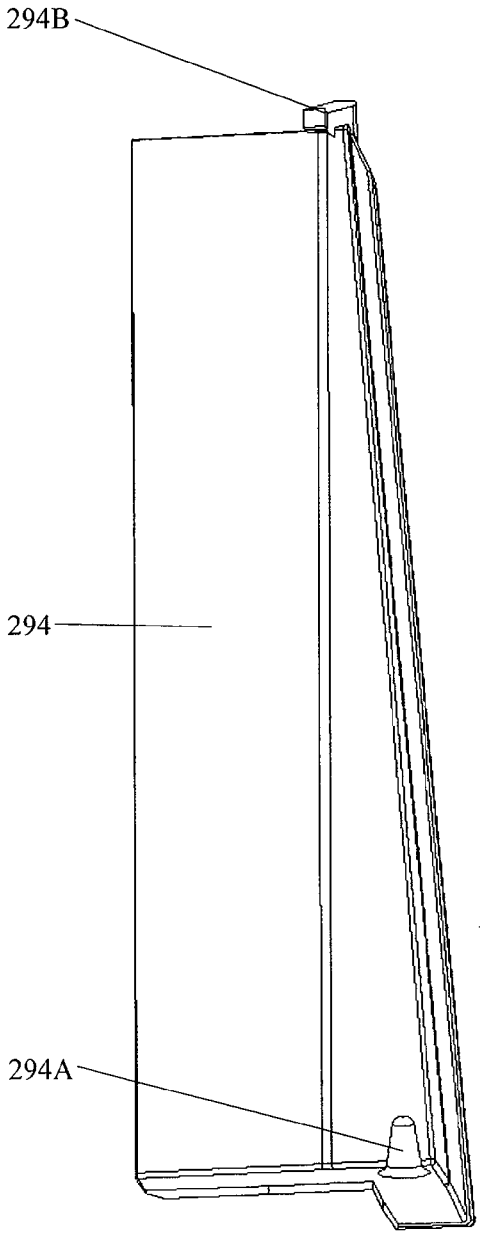
FIG. 28 shows a rear perspective view of the corner fascia component of FIG. 27.
Figure 29:
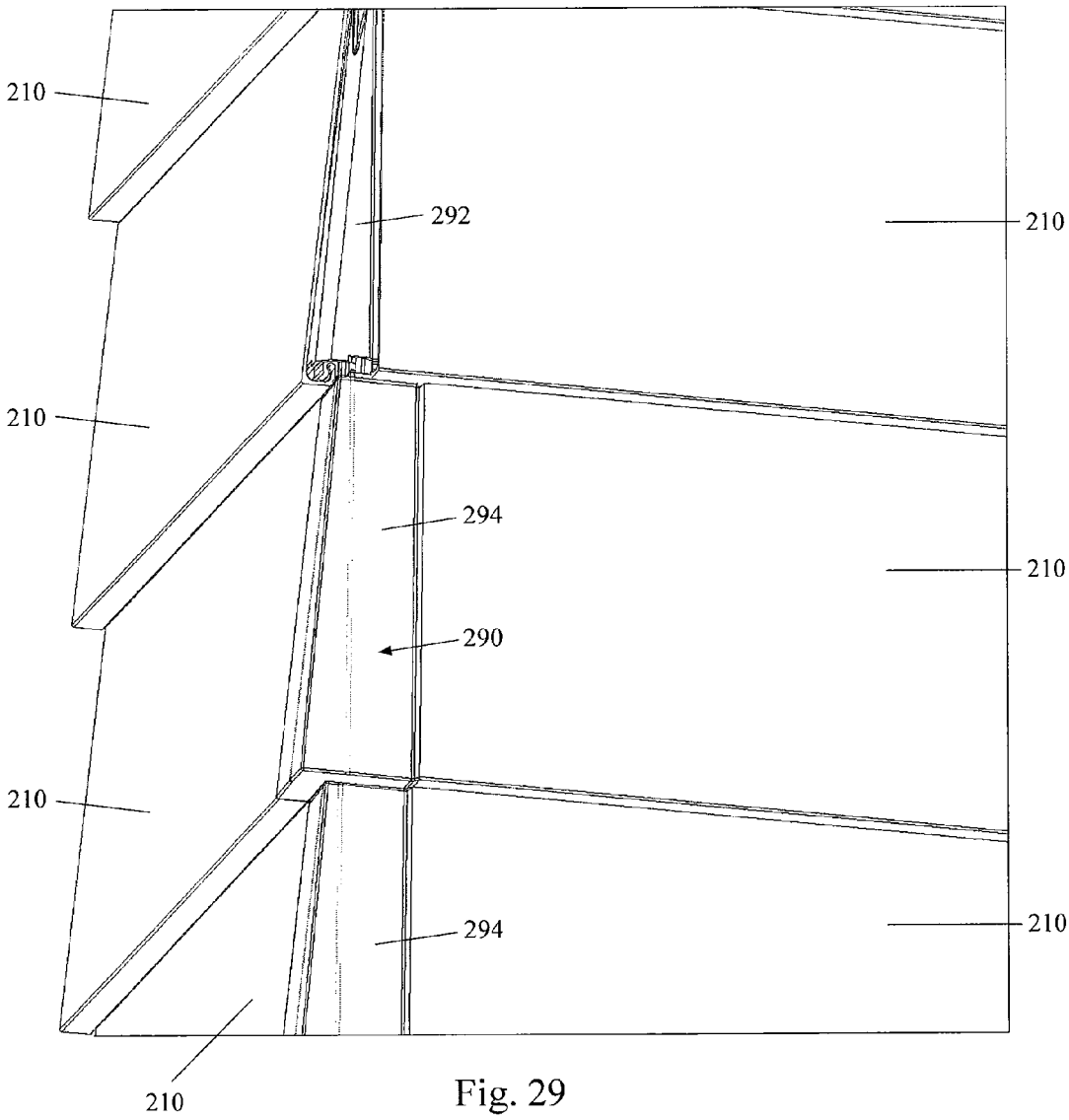
FIG. 29 shows a perspective view of corner components of FIGS. 26-28 used with assembled building products, in accordance with one embodiment.

Referring to FIGS. 19 and 20, in another example, a seam support member 221 is used at seams between side-by-side building products 210. The seam support member 221 can be used in place of at least some of the flashing clips 219 described above. In one example, the seam support member 221 is relatively rigid. In another example, the seam support member 221 is placed behind a seam between two side-by-side building products 210, such that the seam support member 221 is disposed between the building products 210 and the structure surface of the building. In one example, the seam support member 221 is wide enough to allow a portion of the seam support member 221 to be positioned behind each of the abutting pultruded products 212, with the portions being sufficiently wide to allow fasteners 220 to be driven through each portion during attachment of the building products 210 with the building. In one example, the seam support member 221 is attached to at least one of the building products 210 using a fastener 220. In another example, the seam support member 221 is attached to only one of the building products 210 using a fastener 220.

In various examples, the seam support member 221 performs one or more functions, including, but not limited to, the following. In one example, the seam support member 221 facilitates alignment of two building products 210 by providing an abutment lip 221A along which top edges of two side-by-side abutting building products 210 can be lined up. In another example, the seam support member 221 serves to control water, such as water entering through the seam between two building products 210. For instance, a ramp-like surface 221B of the seam support member 221 downwardly directs water entering through the seam and inhibits the water from contacting the surface of the building. In still another example, the seam support member 221 acts as a spacer clip 218, as described above, to space the building product 210 from the surface of the building. In a manner similar to that described above with respect to the spacer clip 218, use of the seam support member 221 creates a water drainage and ventilation plane to facilitate the draining of condensation and other moisture disposed between the building product 210 and the building and to allow for ventilation between the building product 210 and the building. In yet another example, the seam support member 221 provides added strength, stability, and structure at the seams between two building products 210 to inhibit deflection and distortion of the building products 210 at the seams.

FIGS. 21-25 show embodiments of some trim components for assembly of the present system onto a structure. These components include an inside corner 240, a J-channel 250, a starter strip 260, an outside corner 270, and a trim casing member 280. For example, the inside corner 240 and the outside corner 270 can be used for inside and outside corners, respectively, where one wall of siding meets another wall of siding. The J-channel 250 can be used to cover or otherwise mask cut edges of one or more siding members, for instance, roughly cut edges of siding members where the siding members meet oddly-shaped vents, windows, structures, or the like. The starter strip 260 can include a shape defining an first engagement feature to mate with the second engagement feature 216 (FIG. 12) of one or more of the plurality of pultruded products 212 discussed above. The starter strip 260 can be used as the first element when siding a building, with the building products (such as product 210) then added to it.

Referring to FIGS. 26-29, in another example, a corner component 290 is used with building products 210 at one or more corners of a building. In one example, the corner component 290 includes a backer member 292 which attaches to the building, for instance at a stud of the frame 225 or at another portion of the building. It is contemplated that the backer member 292 is attached using fasteners such as screws, nails, bolts, or the like, although this is not intended to be limiting. Other fastening means are further contemplated, such as, for instance, adhesives and the like.

In one example, the backer member 292 is attached to the building before the building products 210 for that area are attached. In this example, the backer member 292 is placed between the building products and the surface of the building and functions in a similar manner to that described above with respect to the seam support member 221. In one example, the backer member 292 facilitates alignment of two adjacent corner building products 210 by providing a top abutment lip 292A along which top edges of two adjacent corner building products 210 can be lined up and a side abutment lip 292C along which side edges of two adjacent corner building products 210 can be lined up. In another example, the backer member 292 serves to control water entering at the corner of the building. For instance, a ramp-like surface 292B of the backer member 292 downwardly directs water entering at the corner and inhibits the water from contacting the surface of the building. In still another example, the backer member 292 acts similar to the spacer clip 218, as described above, to space the one or more building products 210 from the surface of the building. In a manner similar to that described above with respect to the spacer clip 218, use of the backer member 292 creates a water drainage and ventilation plane to facilitate the draining of condensation and other moisture disposed between the building product 210 and the building at the corner of the building and to allow for ventilation between the building product 210 and the building. In yet another example, the backer member 292 provides added strength, stability, and structure at the building corners to inhibit deflection and distortion of the building products 210 at the corners.

In one example, once the building products 210 and the backer member 292 are attached to a corner of the building at a particular level, a fascia member 294 can be attached to the corner. Various ways of attaching the fascia member 294 to the backer member 292 are contemplated hereby. For instance, in one example, the fascia member 294 includes a protrusion 294A or other such member that is configured to be placed behind a bottom edge 292D of the backer member 292, such that the bottom edge 292D becomes lodged between the protrusion 294A and the front wall of the fascia member 294. A snap arm 294B or other similar feature at the top of the fascia member 292 can then be snapped or otherwise engaged with an attachment surface 292E of the backer member 292. Once the fascia member 294 is in place, the next level of siding at the corner can be installed. While the above discusses one example of attaching the fascia member 294 to the backer member 292, other attachment means are contemplate, such as, for instance, detents, tabs-in-slots, fasteners, adhesives, and the like.

It is important to note that while the above discusses one example of a corner component 290, other examples of corner components are contemplated. For instance, in one such example, the corner component could be placed between building products and the corner of building, with the building products meeting along a seam at the corner of the building. The building products of this example could be mitered along the meeting edges so as to make a finished look to the siding corners formed. In another example, a corner component could be used to attach over building products at a corner of a building. The corner component of this example covers over the seam between the building products and, in turn, conceals the corner and any rough cuts of the building products along the edges at the corner.

Like the products 10, 20 discussed above, the building products 210 can be formed by pultrusion and can have a wall thickness of about 0.06 inches to about 0.120 inches. Some embodiments have a wall thickness of as small as about 0.03 inches. Some embodiments can have a thickness of about 1 inch or more. The pultrusions can include a coating or a film 27 on at least a portion of the exterior surface of the member for additional protection from elements or ultraviolet protection. For example, the pultrusion and coating can be as described in commonly assigned U.S. Pat. No. 6,197,412, which is incorporated herein by reference in its entirety. The building products 210 can have various heights, for example, from three inches or less to 4 feet or more. They can have lengths of up to thirty feet or longer. In various examples, the building products 210 can define various cross-section siding shapes. In some embodiments, these shapes include straight lap, dutch lap, curved lap, beaded, flat, grooved/fluted, and many other profile shapes. Dimension of the lap height are typically three to twelve inches but could be taller or shorter. The number of repeating laps on a given profile are typically one to four but could be many more.

The building products 210 can be formed in virtually any profile shape. Accordingly they can be provided with projecting portions, and other profile shapes, so as to define relief portions on the exterior of the house. Accordingly, they can be formed to be aesthetically pleasing, such as present siding shapes, as discussed above.

Furthermore, the building products 210 provide protection from wind and rain. In one example, each building product 210 itself is air-tight and weather-tight. In one example, the joint between adjacent building products 210 can be sealed to provide an air-tight, rain-tight seal. Additionally, in one example, the building products 210 are stiff enough and sturdy enough to provide structural support when attached directly to the frame 225. For example, the building product 210 of one example can be stiff enough to match or exceed the strength of OSB as sheathing.

Additionally, in one example, coloring is added during manufacturing of the building products 210 so that the building products 210 are pre-finished. By providing a finished colored surface on the building products 210, the building products 210 can be installed as is and do not need to be painted or touched up.

Referring to FIGS. 15-18, in one example, a method includes arranging at least one spacer clip 218 along a first building product 210. In one example, the at least one spacer clip 218 of the first building product 210 is aligned with a stud or other member of a frame 225 of a building. In another example, the at least one spacer clip 218 of the first building product 210 is aligned between studs or other members of the frame 225 of a building. In still another example, multiple spacer clips 218 of the first building product 210 are aligned with at least some studs (every stud, every other stud, or some other combination of studs) or other members of the frame 225, aligned in between studs or other members of the frame 225, or aligned with a combination of studs and spaces in between studs of the frame 225. The first building product 210 is fastened to a surface, such as the frame 225, sheathing 230, house wrap 232, or other surface, of the building. At least one spacer clip 218 is arranged along a second building product 210. As with the first building product 210, the at least one spacer clip 218 of the second building product 210 is aligned with a stud or other member of the frame 225 of the building. The second building product 210 is fastened to the surface of the building adjacent the first building product 210 with a joint member or second engagement member 216 of the second building product 210 mating with a joint member or first engagement member 214 of the first building product 210. In one example, the at least one clip 218 and the first or second building product 210 are fastened directly to the frame 225 of the building. In one example, the building product 210 is adapted to be external siding of the building.

Still referring to FIGS. 15-18, in another example, a method includes fastening a first building product 210 to a surface of a building. A second building product 210 is fastened to the surface of the building adjacent the first building product 210 with a joint member or second engagement feature 216 of the second building product 210 mating with a joint member or first engagement feature 214 of the first building product 210. In this way, any curvature in the first or second building product 210 increases frictional engagement between the first and second engagement features 214, 216 of the first and second building products 210, as discussed in more detail above. In one example, the curvature of the first or second building product 210 results from attachment of the first or second building product 210 with the surface of the building. In another example, the curvature of the first or second building product 210 results from manufacturing of the first or second building product 210. In one example, at least one of the first building product 210 or the second building product 210 is fastened directly to a frame 225 of the building. In one example, the first and second building products 210 are adapted to be external siding of the building.

The pultruded building products discussed herein can be designed in various manners. For example, a building product can include a pultruded part that constitutes exterior siding of a building. Also a building product can include a pultruded part that constitutes siding and a weather-tight barrier. Also a building product can include a pultruded part that constitutes siding and the external and structural sheathing of a building. Some embodiments provide exterior siding, sheathing, and a weather-tight barrier. In some embodiments, a building product can include a pultruded part that constitutes the necessary attachments, trim, and accessories for installing siding, weather barrier, and sheathing.

The present pultruded building products offer the low thermal expansion that vinyl and metal siding lacks. Pultruded products can be formulated to exhibit dent resistance that metal siding lacks. Pultruded products are thermal insulators while metal siding is thermally conductive. Pultruded products do not soften due to solar heat gain, even in very dark colors, unlike vinyl siding. Pultruded products are manufactured with a particular finish color and do not require painting or touching up like fiber cement siding. In one example, pultruded products can be designed and formulated to have superior structural properties in terms of actual strengths and strength-to-weight ratios compared to traditional sheathing products like plywood or OSB.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A siding system comprising: a siding product including a first side; second side; a first engagement feature disposed proximate the first side, the first engagement feature including a slot including a bump extending into the slot; and a second engagement feature disposed proximate the second side, the second engagement feature including a tab with an enlarged portion configured to selectively frictionally engage with the bump of the first engagement feature of another similar siding product; and a spacer clip comprises:

a first leg; and a second leg coupled with the first leg to form a U-shape, the first and second legs being configured to accommodate a portion of the siding product therebetween for frictional engagement therewith, wherein, when the siding product is attached to the surface of the building, the first leg is disposed between the siding product and the surface of the building, the first leg having a thickness to space the siding product a distance away from the surface of the building, wherein the clip is configured to be attached to the surface of the building with a fastener disposed through each of the first and second legs and the portion of the siding product.

2. The siding system of claim 1, wherein the clip is slidable along the portion of the building product.

3. The siding system of claim 1, wherein the second leg is angled toward the first leg.

4. The siding system of claim 1, wherein any curvature in the siding product increases frictional engagement between the enlarged portion of the second engagement feature of the siding product and the bump of the first engagement portion of the other similar siding product.

5. The siding system of claim 1, wherein the clip is configured to frictionally engage with an attachment portion of the siding product, the attachment portion being configured to fasten the siding product to the building.

6. The siding system of claim 5, wherein the clip and the attachment portion are configured to accept the fastener therethrough for attachment of the siding product to the surface of the building.

7. The siding system of claim 6, wherein the clip includes a hole configured to accept the fastener therethrough.

8. A siding system comprising:

a siding product including a profile defining a shape of exterior siding and configured for attachment to a surface of a building, the siding product including:

a first engagement feature including a slot including a bump extending into the slot; and a second engagement feature including a tab with an enlarged portion configured to selectively frictionally engage with the bump of the first engagement feature of another similar siding product, wherein any curvature in the siding product increases frictional engagement between the enlarged portion of the second engagement feature of the siding product and the bump of the first engagement portion of the other similar siding product;

a clip including:

a first leg; and a second leg coupled with the first leg to form a U-shape, the first and second legs being configured to accommodate a portion of the siding product therebetween for frictional engagement therewith, wherein, when the siding product is attached to the surface of the building, the first leg is disposed between the siding product and the surface of the building, the first leg having a thickness to space the siding product a distance away from the surface of the building; and a fastener configured to attach the clip and the siding product to the surface of the building, the fastener being disposed through the first and second legs of the clip and through the portion of the siding product between the first and second legs of the clip.

9. The siding system of claim 8, wherein the siding product includes an attachment portion configured to fasten the siding product to the building.

10. The siding system of claim 9, wherein the clip is configured to frictionally engage with the attachment portion.

11. The siding system of claim 8, wherein the first engagement feature is disposed on or near a first side of the siding product, and the second engagement feature is disposed on or near a second side of the siding product, the slot being open in a direction generally toward the second side of the siding product, and the tab is oriented in a direction generally toward the first side of the siding product.

12. The siding system of claim 8, wherein the curvature of the siding product results from attachment of the siding product with the surface of the building.

13. The siding system of claim 8, wherein the curvature of the siding product results from manufacturing of the siding product.

14. The siding system of claim 8, wherein the siding product comprises a pultruded product.

15. A building product for attachment to a surface of a building, the building product comprising:

a siding product including:

a first side;

a second side;

a first engagement feature disposed on or near the first side, the first engagement feature including a slot including a bump extending into the slot; and a second engagement feature disposed on or near the second side, the second engagement feature including a tab with an enlarged portion configured to selectively frictionally engage with the bump of the first engagement feature of another similar siding product, the slot being open in a direction generally toward the second side of the siding product, and the tab being oriented in a direction generally toward the first side of the siding product, wherein the siding product includes a curvature configured to increase frictional engagement between the enlarged portion of the second engagement feature of the siding product and the bump of the first engagement portion of the other similar siding product;

a clip including:

a first leg; and a second leg coupled with the first leg to form a U-shape, the first and second legs being configured to accommodate an attachment portion of the siding product therebetween for frictional engagement therewith, wherein, when the siding product is attached to the surface of the building, the first leg is disposed between the siding product and the surface of the building, the first leg having a thickness to space the siding product a distance away from the surface of the building; and a fastener configured to attach the clip and the siding product to the surface of the building, the fastener being disposed through the first and second legs of the clip and through the attachment portion of the siding product between the first and second legs of the clip.

16. The building product of claim 15, wherein the attachment portion of the siding product is disposed between the first side and the first engagement feature.

17. The building product of claim 15, wherein the curvature of the siding product results from attachment of the siding product with the surface of the building.

18. The building product of claim 15, wherein the curvature of the siding product results from manufacturing of the siding product.

19. The building product of claim 15, wherein the siding product comprises a pultruded product.

* * * * *